US006668748B2

(12) United States Patent
Kemp et al.

(10) Patent No.: US 6,668,748 B2
(45) Date of Patent: Dec. 30, 2003

(54) SUBMERSIBLE ARTICLES AND METHOD OF MANUFACTURE THEREOF

(75) Inventors: Nicholas Ian Kemp, London (GB); Robert Murdoch Mackie, Sheffield (GB); Ian Robert Mackie, Sheffield (GB)

(73) Assignee: H2Eye (International) Limited, Tortola (VG)

( * ) Notice: Subject to any disclaimer, the term of this patent is extended or adjusted under 35 U.S.C. 154(b) by 0 days.

(21) Appl. No.: 10/087,532

(22) Filed: Mar. 1, 2002

(65) Prior Publication Data

US 2003/0166366 A1 Sep. 4, 2003

(51) Int. Cl.[7] ..... B63G 8/00
(52) U.S. Cl. ..... 114/312; 114/357
(58) Field of Search ..... 114/312, 341, 114/342, 357

(56) References Cited

U.S. PATENT DOCUMENTS 3,725,968 A * 4/1973 Knapp et al. ..... 15/104.061
3,770,039 A * 11/1973 Pfoertner ..... 152/221
5,035,425 A * 7/1991 Edwards ..... 473/609
5,634,423 A 6/1997 Lashman
6,224,706 B1 5/2001 Matich

* cited by examiner

*Primary Examiner*—Sherman Basinger
(74) *Attorney, Agent, or Firm*—Renner, Otto, Boissell & Sklar, LLP

(57) ABSTRACT

A submersible article comprises a buoyancy body formed from polyurethane foam having a first density, which is at least partly overmolded with a protective skin of polyurethane foam having a second density higher than the first density. The lower density foam of the body gives the article buoyancy, while the higher density protective skin strengthens the article and gives impact resistance. The protective skin can be stiffened, either uniformly or locally, by the addition of glass fiber or other reinforcing material which is arranged over the buoyancy body prior to the overmolding. The article can be made by a two-stage molding process.

25 Claims, 11 Drawing Sheets

SUBMERSIBLE ARTICLES AND METHOD OF MANUFACTURE THEREOF

BACKGROUND OF THE INVENTION

The invention relates to submersible articles and parts for submersible articles, including submersible vehicles, and a method of manufacture of submersible articles and parts therefor.

Many kinds of submersible article are known. These include propulsion units for divers, which may be hand-held or configured to be strapped to a diver's body, underwater exploration vehicles which may be manned or remote-controlled, and mooring buoys for marine tankers. Articles of this type are required to function satisfactorily in an underwater environment, and hence need to be constructed in such a way as to, and from materials which, permit this. For example, the materials and construction need to give sufficient buoyancy while at the same time being strong enough to withstand hydrostatic pressures at the depth of water for which the article is designed. Materials need to be waterproof, and preferably not overly heavy, both with regard to achieving a desired buoyancy and also for ease of carrying if the article is designed to be portable. Also, the construction needs to be suitable for housing components of the article such as motors, batteries, propellers and the like.

The use of various plastics materials in submersible and other aquatic articles has been proposed with the aim of meeting the above and other objectives. Syntactic epoxy foam, which is a foam containing hollow glass microspheres, is suitable for remote-controlled submersible vehicles designed for deep water use, as it can withstand depths in excess of 2000 m.

U.S. Pat. No. 5,634,423 discloses a personal submersible marine vehicle having a hull in the form of a hollow shell made from polyethylene by rotation molding. The shell houses a battery and control units (and weights to adjust the buoyancy) which are electrically insulated from each other by high density polyurethane foam which is pumped into the shell after the battery and units are installed to fill the remaining space in the shell. This gives a watertight hull which is neutrally buoyant and protected on the outside by the rigid polyethylene. However, once embedded in the polyurethane, the battery and units are difficult to replace if they become faulty. It is also necessary to achieve a good bond between the two types of plastic to maintain the structure of the hull and to ensure it is watertight, as an opening in the polyethylene shell is needed through which the polyurethane is pumped.

U.S. Pat. No. 6,224,706 discloses a surfboard or sailboard made from expanded polystyrene which is strengthened by being encapsulated in a sheet of thermoplastic material. Encapsulation is achieved by laying heated thermoplastic material over the polystyrene board, and drawing air through the permeable polystyrene so that the thermoplastic conforms to the shape of the board. This gives a light yet strong structure. However, the use of sheet material to form an outside shell by effectively wrapping the sheet around the polystyrene is disadvantageous as regards achieving a visually pleasing exterior finish, which is desirable in articles designed for leisure purposes.

SUMMARY OF THE INVENTION

According to one aspect of the invention there is provided a submersible article, comprising: a buoyancy body formed from polyurethane foam of a first density; and a protective skin formed from polyurethane foam of a second density higher than the first density, wherein the protective skin is overmolded onto the buoyancy body.

The lower density of the inner, buoyancy body gives a desired degree of buoyancy, while the higher density protective skin forms a tough and strong outer shell which protects the inner body and provides impact resistance. Use of high density foam alone to mold the entire article would give desirable toughness and strength, but the article would be too heavy to be sufficiently buoyant for submersible use. This is overcome by the proposed two-layer structure, in which the lower density foam used for the inner part is light enough to provide buoyancy. The molded aspect of the outer layer permits a good surface finish to be given to the article. Also, polyurethane has good adhesive properties, so that the use of it for both layers means that the inner and outer polyurethane parts bond strongly together to give a robust article.

The density of the inner body may be between 100 kg/m$^3$ and 600 kg/m$^3$, and the density of the outer skin may be between 300 kg/m$^3$ and 1200 kg/m$^3$. Other values outside this range or subranges within this range may also be used. An inner body density of 300 kg/m$^3$ is high enough to allow the article to withstand the hydrostatic pressure of water at a depth of about 150 m.

If desired, the outer protective skin may comprise reinforcing material which increases the stiffness of the outer protective skin. A semi-flexible polyurethane can be used for the outer protective skin, but this may not be satisfactorily stiff for particular uses of the article. For example, the reinforcing material may be distributed unevenly throughout the outer protective skin so as to impart a stiffness which varies over the outer protective skin in a preselected manner. In this way, a greater stiffness can be given to areas such as carrying handles.

Preferably, the reinforcing material comprises glass fiber. This is incorporated suitably throughout the outer protective skin during the molding of the polyurethane, so as to impart the desired stiffness where required.

According to another aspect of the invention there is provided a method of manufacturing a submersible article, comprising: providing a buoyancy body comprising polyurethane foam of a first density; placing the buoyancy body in a mold; and overmolding a protective skin onto the buoyancy body using polyurethane foam of a second density higher than the first density.

In an embodiment, the method comprises: providing a first mold and a second mold; using the first mold to form, from polyurethane foam having a first density, an inner body with an outer surface; removing the inner body from the first mold; placing the inner body in the second mold; and using the second mold to form, from molded polyurethane foam having a second density which is higher than the first density, an outer protective skin which adheres to and at least partially covers the outer surface of the inner body.

This method can provide a straightforward way of manufacturing an submersible article having the desired qualities of buoyancy and strength. Use of polyurethane foam for both inner and outer parts means that similar molding processes can be used to form each part. This simplifies manufacturing and reduces costs compared to the production of previously proposed articles having parts formed from different materials by different processes.

The method permits a wide variety of shapes of article to be produced. This contrasts with prior art methods, in which molding is only used for one part, so that either the outer shell or the inner buoyant component must conform to the shape of the other part. Also, the formation of the outer protective skin by overmolding the inner block gives a good exterior finish, good contact and a strong bond between the parts, and the outer protective skin can be configured to cover as much or as little of the inner block as desired, by use of an appropriate mold.

The method may additionally comprise: arranging reinforcing material over at least part of the buoyancy body before the overmolding so that the reinforcing material embeds in the polyurethane foam of the protective skin during the overmolding. The reinforcing material can be used to increase the stiffness of the outer protective skin. Preferably, the reinforcing material is fastened to the inner body to inhibit migration of the reinforcing material through the outer protective skin. Fastening can stop the reinforcing material from moving through to the outside of the outer protective skin during molding, which can have a detrimental effect on the exterior finish of the article. Glass fiber may be used as the reinforcing material.

In a preferred embodiment, the reinforcing material is distributed unevenly over the outer surface, so as to impart a stiffness which varies over the outer protective skin in a preselected manner. Hence the outer protective skin can be stiffened locally if required, for example, around carrying handles and the like. This is made possible by the application of the reinforcing material over the inner body; if the reinforcing material were added directly to the higher density polyurethane before molding, it would not be possible to control its distribution.

Advantageously, the method further comprises, abrading at least part of the outer surface of the inner body prior to the overmolding. Polyurethane has good natural adhesive properties, so that the use of it for both parts of the article gives a good bond between the parts; however, the strength of the bond is improved by abrading the inner body to provide a key for the outer protective skin. Also, abrasion may be used to remove any release agent used in the manufacture of the inner body.

The mold used for the overmolding may be provided with at least one locator operable to position the inner body within the second mold in a preselected location with respect to the second mold. This gives greater flexibility in the shape of the outer protective skin, so that it can be more than just a skin conforming to the shape of the inner body. Also, the provision of fasteners allows the outer protective skin to be formed over the whole of the inner body in a single molding step, as the inner body can be held away from the sides of the second mold at all points.

Another aspect of the present invention is directed to a submersible vehicle having a hull comprising: a buoyancy body formed from polyurethane foam of a first density; and a protective skin formed from polyurethane foam of a second density higher than the first density, wherein the protective skin is overmolded onto the buoyancy body.

BRIEF DESCRIPTION OF THE DRAWINGS

For a better understanding of the invention and to show how the same may be carried into effect reference is now made by way of example to the accompanying drawings in which.

DETAILED DESCRIPTION

Figure 1:
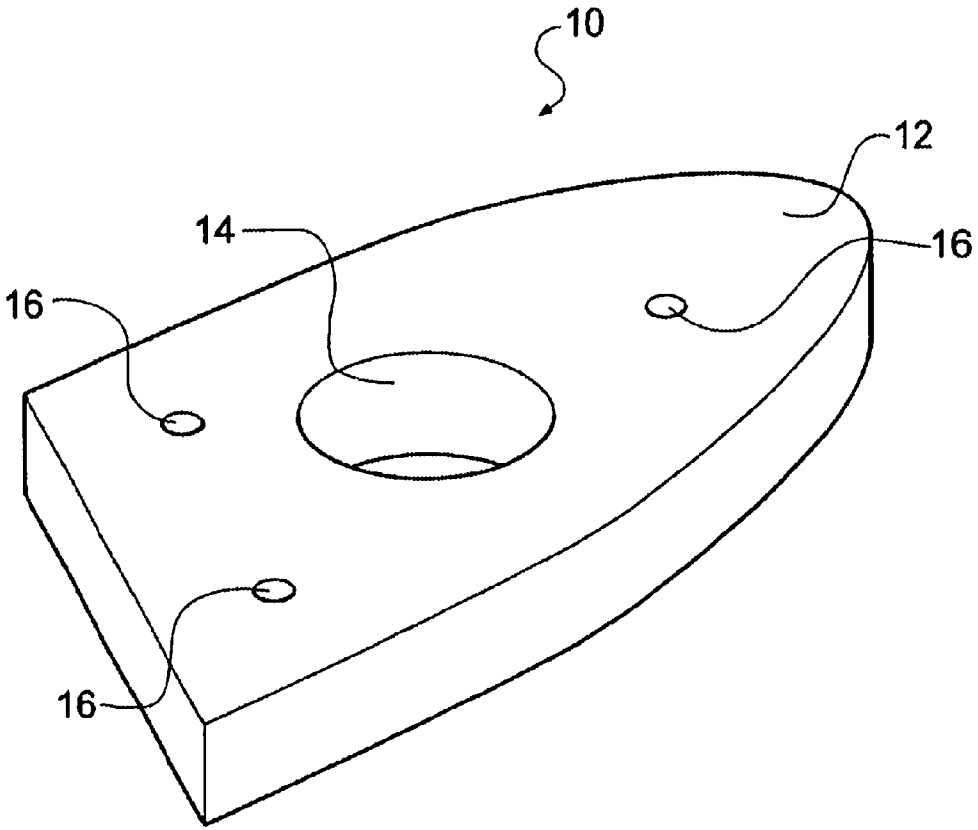
FIG. 1 shows a perspective view of an inner body of a submersible article according to an embodiment of the present invention.

FIG. 1 shows a perspective view of an inner body of a submersible article. The inner body 10 has an outer surface 12. A central aperture 14 extends through the inner body 10, and may be used to house components such as batteries, control panels, cameras or the like, which are diagrammatically illustrated at 15 in FIG. 6. Three locator holes 16 are positioned around the central aperture. The purpose of these locator holes 16 will be described later.

The shape of the inner body 10 is by way of example only, and is greatly simplified for ease of understanding. It is not intended to represent any particular submersible article or part of an article. However, it is to be understood that the inner body may have any shape desired, depending on its intended purpose.

The inner body 10 is formed from polyurethane foam by a molding process. The molding of polyurethane foam is a known technique, so it will be described only briefly here.

Figure 2:
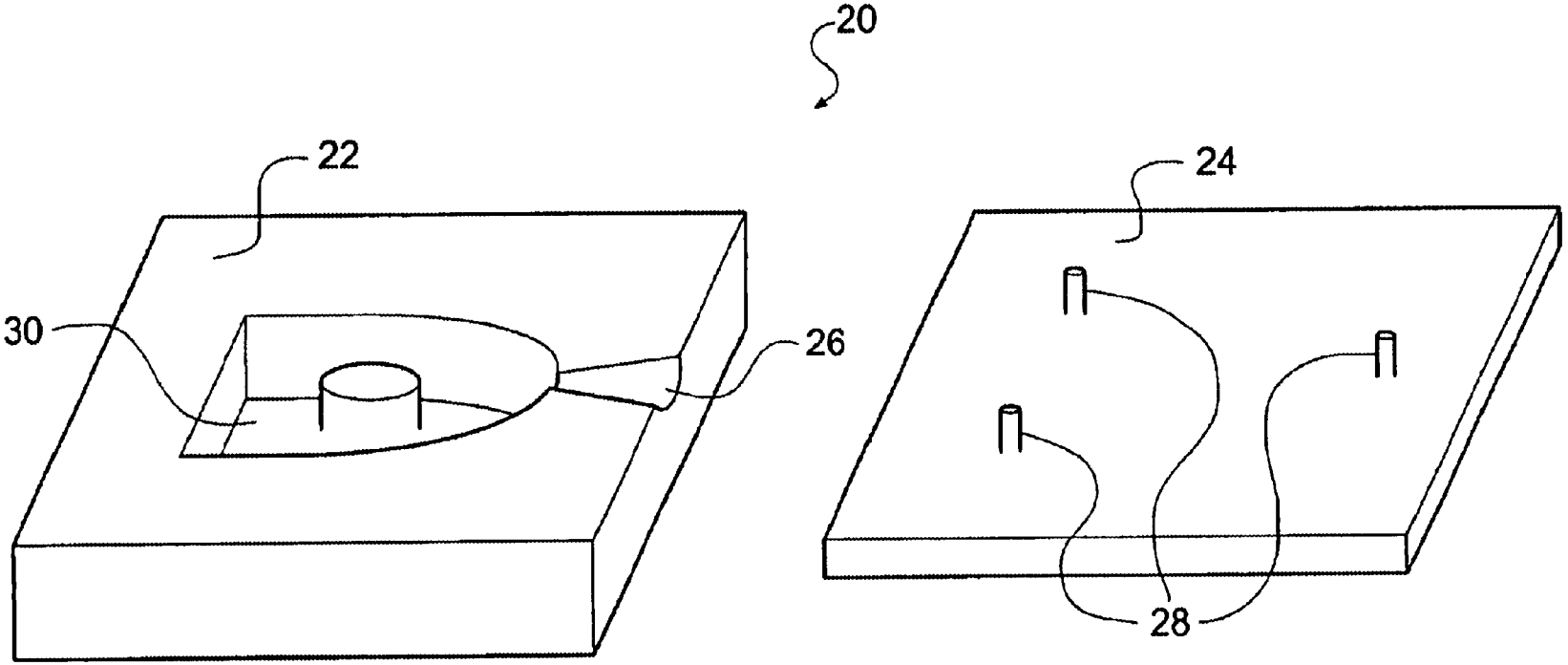
FIG. 2 shows a perspective view of a mold for use in a method according an embodiment of the present invention.

FIG. 2 shows a first mold 20, suitable for forming the inner body 10. The first mold 20 is made from aluminum. The first mold 20 comprises a first mold part 22 and a second mold part 24, which can be abutted together to define a first mold volume 30 corresponding to the desired shape of the inner body 10. The first mold part has a groove 26 extending to its outer edge. The second mold part 24 has three molding protrusions 28 which form the locator holes 16 in the inner body. When the two mold parts 22, 24 are abutted, the groove 26 defines an opening leading from the exterior of the first mold 20 to the first mold volume 30, through which polyurethane can be introduced into the first mold 20. Although the mold illustrated has two parts, it is merely exemplary, and a mold may comprise a greater number of parts, depending on the complexity of the shape to be molded.

Before the first mold 20 is closed by abutting the first and second mold parts 22, 24, the surface of the first mold volume is treated with a mold release agent, which is used to prevent the polyurethane foam from sticking to the mold parts 22, 24, so that the inner body 10 can be easily removed from the mold 20 after molding. The mold release agent is typically a wax, which is heated before application to the first mold 20, and then allowed to dry.

The molding process is achieved by then feeding a sufficient quantity of polyurethane in a heated liquid form into the first mold 20 through the opening formed by the groove 26. The first mold 20 is also heated. The first mold 20 is then rotated so that the surface of the first mold volume 30 is coated in the liquid. This gives a good and even outer surface 12 to the finished inner body 10.

After a short delay, known as the cream time, the liquid reacts in the known manner to form a foam, the bubbles in which are formed by carbon dioxide produced as a by-product of the reaction. The foam expands to fill the first mold volume 30 thus forming the inner body 10. Some of the foam is allowed to vent through the opening for a few seconds to remove some of the larger air bubbles. Then the opening is plugged, so as to allow pressure to build up inside the first mold 20, which causes consolidation of the foam.

After the foam has consolidated and cooled, or cured, the first mold 20 is opened by taking apart the first and second mold parts 22, 24, and the inner body 10 is removed.

As is well-known, there are a number of varibles and conditions to be considered when molding with polyurethane foam, each of which have an impact on the quality of the end result. These include:

- temperature of the mold;
- temperature of the liquid polyurethane;
- ambient temperature and humidity of the local environment;
- conditions under which the liquid polyurethane is prepared for use;
- choice of polyurethane;
- choice of mold release agent;
- mold release agent drying time;
- amount of foam allowed to vent before plugging of the mold opening;
- position of the opening with respect to the mold volume;
- provision and location of any air bleeding points around the mold;
- the angle at which the mold is held while the liquid polyurethane is poured into it;
- the way in which the mold is rotated to coat the liquid over the inner surface of mold volume;
- the angle at which the foam expands and rises with respect to the mold volume;
- the time allowed for the molded article to cure in the mold before it is removed.

A person skilled in the art of polyurethane molding will be familiar with these factors and their interplay, and will readily be able to fabricate the required inner body as the molding process can be performed entirely in accordance with conventional practice.

It is necessary to take the expansion of the foam into account when filling the mold with liquid polyurethane, since there must be enough empty space left in the mold volume to allow the foam to expand to a desired density. A purpose of the inner body is to give a desired level of buoyancy to the submersible article. Therefore, the polyurethane foam is selected to have an appropriate, relatively low, density. For example, a density between 100 kg/m$^3$ and 600 kg/m$^3$ may be chosen. Alternatively, densities in ranges including 200 kg/m$^3$ to 600 kg/m$^3$, 200 kg/m$^3$ to 500 kg/m$^3$, 200 kg/m$^3$ to 400 kg/m$^3$, or 300 kg/m$^3$ to 600 kg/m$^3$, 300 kg/m$^3$ to 500 kg/m$^3$, 300 kg/m$^3$ to 400 kg/m$^3$ may be chosen.

Also, the density should be high enough for the foam to have sufficient strength to withstand hydrostatic pressure at whatever depth of water it is intended to be used. Foam with a density of 300 kg/m$^3$ can withstand the pressure occurring at around 150 m. If use only in shallower depths of water is envisaged, then lower foam densities can be tolerated, such as 100, 150, 200 or 250 kg/m$^3$. The foam density required is approximately linearly related to the depth of water, so that 100 kg/m$^3$ foam is suitable for operation at around 50 m, 150 kg/m$^3$ foam is suitable for operation at around 75 m, and 200 kg/m$^3$ foam is suitable for operation at around 100 m. However, at low foam densities, the foam may become weak on a microscopic level, so that if it is directly exposed to water the water pressure can burst individual bubbles in the foam and penetrate the body of the foam, which is undesirable. Therefore, it may be necessary to protect lower density foams from direct exposure to water.

Also, the foam used for the inner body 10 is chosen to be substantially rigid. This also contributes to the ability of the submersible article to withstand hydrostatic pressure.

After removal from the first mold 20, the inner body 10 is prepared for the application of an outer layer. The outer layer is also molded from polyurethane foam, as will be explained in more detail later. Polyurethane has good natural adhesion, so the outer layer bonds well to the inner body 10 without the need for additional fixatives such as adhesives or pins. However, to enhance the bonding, and therefore improve the final structure of the article, the outer surface 12 of the inner body 10 may be treated to give a key for the outer layer. A particularly effective method of providing a key is to roughen or abrade the outer surface 12. Additionally, abrasion can be used to remove any mold release agent remaining on the outer surface 12.

Figure 3:
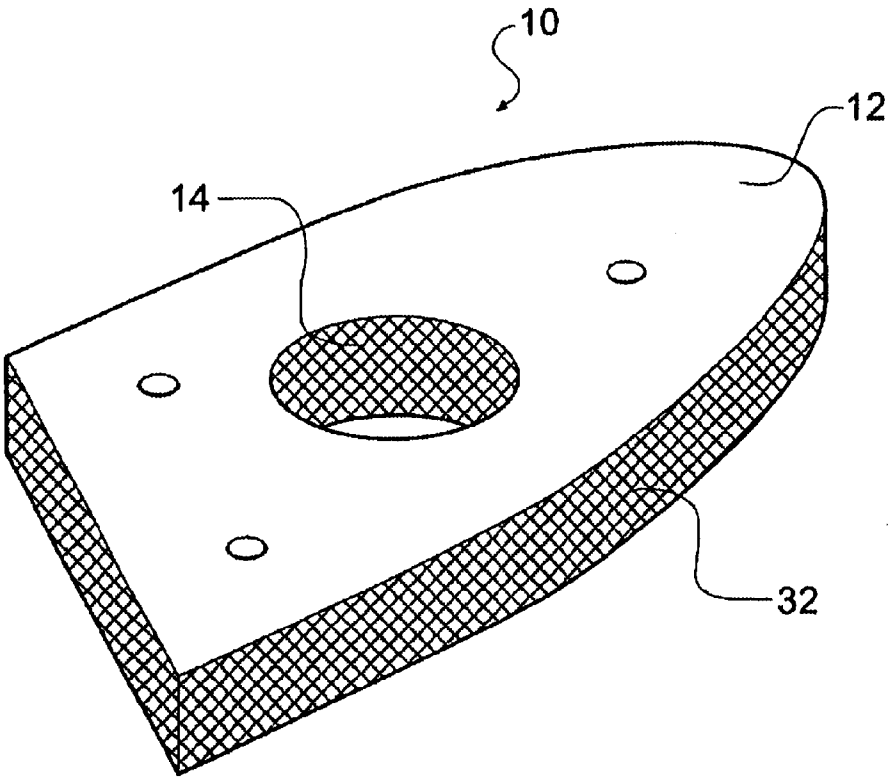
FIG. 3 shows a perspective view of the inner body of FIG. 1 with its outer surface abraded.

FIG. 3 shows a perspective view of the inner body 10 after abrasion of the outer surface 12. Selected parts of the outer surface 12 are covered in abrasions 32. Only those parts of the outer surface 12 which are to be covered by an outer layer are abraded. In the illustrated example, these parts are the outside wall and underside (not shown) of the inner body and the side wall of the aperture 14. The extent of the outer layer with respect to the inner body 10 is determined by the intended design of the submersible article or part thereof.

Abrasion may be performed by any method which gives a roughened texture to the outer surface 12. Examples of suitable methods include rubbing the outer surface with an abrasive substance such as sand paper or emery cloth, or scoring the outer surface with a blade. For a large-scale manufacturing concern, it may be most suitable to perform abrasion by a technique such as sand-blasting.

Figure 4:
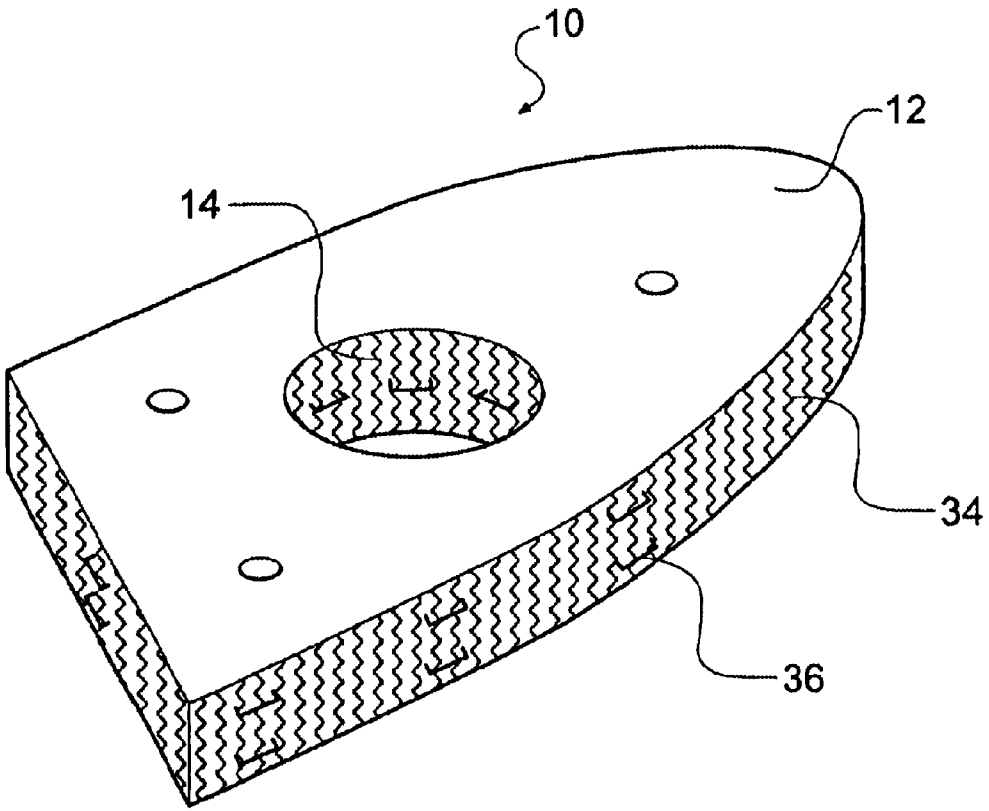
FIG. 4 shows a perspective view of the inner body of FIG. 1, with reinforcing material applied to its outer surface.

FIG. 4 shows a further perspective view of the inner body 10, after a next step in the manufacture of the submersible article. This step involves applying a layer of reinforcing material 34 over those parts of the outer surface 12 of the inner body 10 which are to be covered by the outer layer. The reinforcing material 34 used in an example is glass fiber in the form of "candyfloss". Other suitable reinforcing materials include carbon fiber, cotton fiber, aramid fiber and gel-spun polyethylene fiber. Fibrous reinforcing materials can give a smooth, high quality surface finish to the submersible article. For applications in which the quality of the surface finish is unimportant, chopped glass may be used as the reinforcing material.

The purpose of the reinforcing material 34 is to increase the stiffness of the outer layer, in the event that the polyurethane foam used for the outer layer is not stiff enough for the intended use of the article. In the case of glass fiber, the fibers become integrated with the foam of the outer layer during molding of the outer layer, to create a glass-fiber reinforced plastic, similar in structure to the commonly-known "fiber glass", which is typically made from polyester or epoxy resin.

The reinforcing material 34 is fastened onto the outer surface 12 of the inner body 10 with staples 36. This is done to inhibit the glass fibers from migrating towards the outside of the outer layer during the molding process, which tends to mar the quality of the exterior finish of the final article. Of course, depending on the type of article, this may or may not be important. For typical leisure-oriented and/or high cost articles, such as diving equipment, a high quality exterior finish is likely to be desirable.

Fasteners other than staples 36 may be used to affix the reinforcing material 34 to the inner body 12. Pins, clips and other fasteners which perform the desired function are all suitable. Adhesive could also be used for the purpose of local pinning of the reinforcing material onto the outer skin of the inner body 10.

Figure 5:
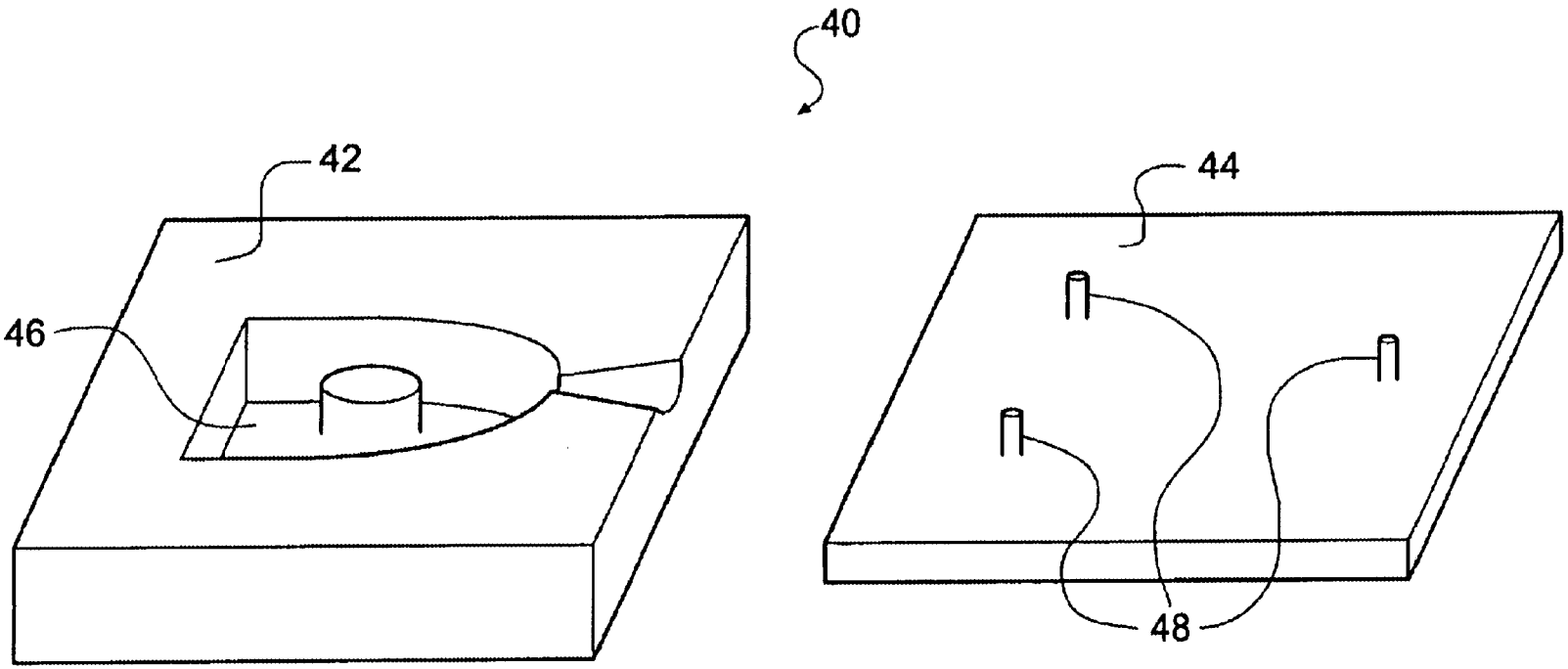
FIG. 5 shows a perspective view of a further mold for use in a method according to an embodiment of the present invention.

FIG. 5 shows a perspective view of a second mold 40, used for forming the outer layer of the article. The outer layer is formed by overmolding directly onto the inner body.

Like the first mold 20, the second mold 40 has a first mold part 42 and a second mold part 44, which define a second mold volume 46 when abutted together. The second mold 40 is similar to the first mold 20, but the second mold volume 46 is larger than the first mold volume 30, so that it can accommodate the inner body 10 while still leaving space for the molding of the outer layer. The second mold 40 need not be configured in this fashion, however. For example, if the outer layer is to be applied over only a small area of the inner body 10, the second mold volume 46 may be only the volume of the outer layer, and be defined in part by the inner body 10 being clamped against a single mold part.

The second mold part 44 of the second mold 40 has three locators 48, having the form of protrusions which have the same size and lay-out as the molding protrusions of the first mold 20. These locators 48 are used to position the inner body 10 correctly within the second mold volume 46. The locators 48 engage with the locator holes 16 in the inner body 10, so that the inner body 10 is held in the desired position in the second mold 40.

Other types and configurations of locators may be used as appropriate, depending on the shape and extent of the outer layer, which determines how the inner body 10 needs to be located within the second mold 40. The locators may be adjustable, by, for example, being screw-threaded protrusions or similar, so that the dimensions of the outer layer relative to the inner body 10 can be altered as desired.

The outer layer is formed by a polyurethane foam molding process similar to that used to form the inner body 10. The surface of the second mold volume 46 is coated with release wax or an alternative mold release agent before the mold is closed, with the inner body 10 secured within it. Liquid polyurethane is poured into the second mold 40, and the mold is turned to coat with the liquid the exposed surface of the second mold volume 46 and also the exposed outer surface of the inner body 10. After the cream time, the liquid expands into a foam which fills the empty parts of the second mold volume 46 to form the outer layer, and is allowed to vent from the opening in the second mold for a few seconds until the opening is plugged to build the pressure within the second mold volume 46. During the molding, the liquid and subsequent foam flows through and around the glass fiber reinforcing material 34, so that it becomes an integral part of the outer layer. After cooling, the second mold 40 is opened and the submersible article, comprising the inner body 10 and the overmolded outer layer, is removed.

Figure 6:
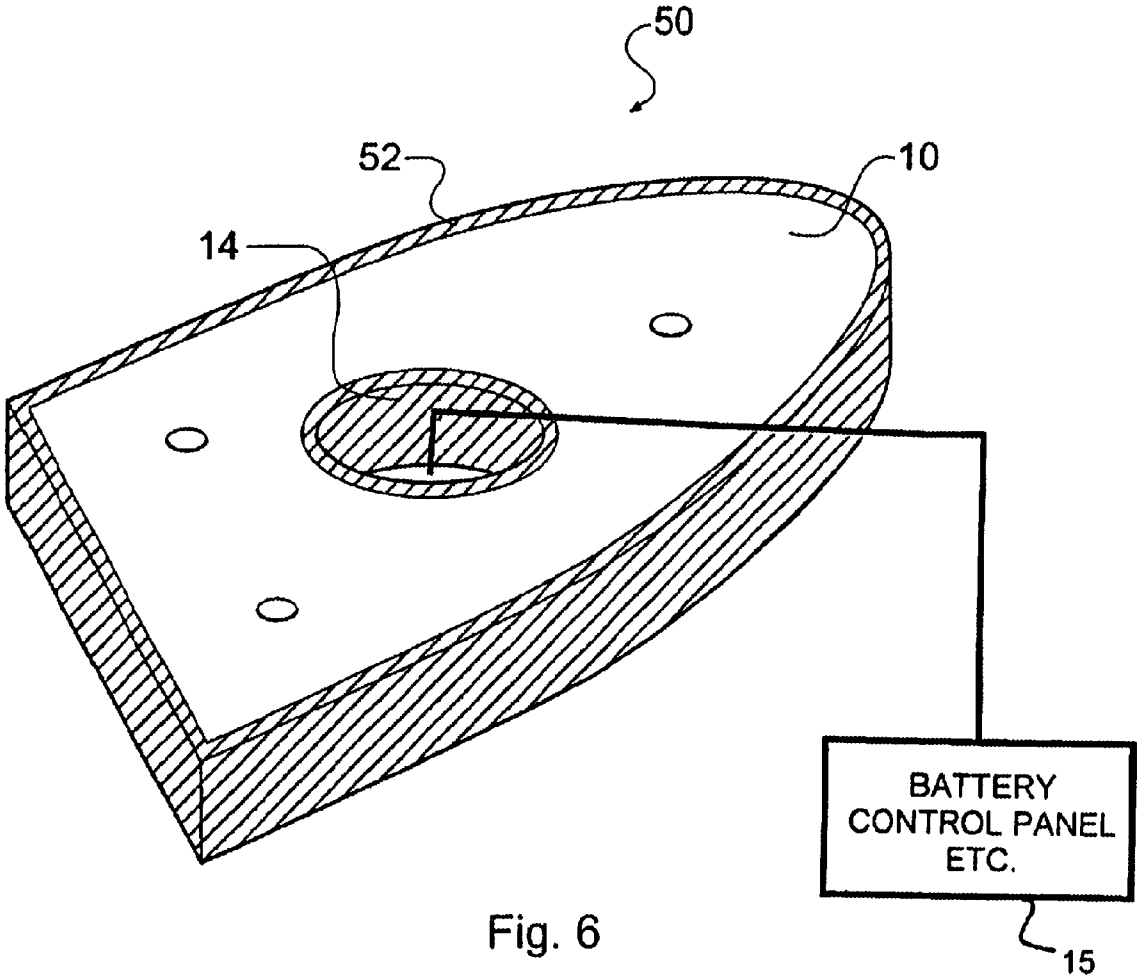
FIG. 6 shows a perspective view of the inner body of FIG. 1, with an outer layer applied it.

FIG. 6 is a perspective view of the submersible article 50, which shows how the outer layer 52 (shaded parts) is molded over the inner body 10. In this case, the outer layer 52 does not cover the whole outer surface of the inner body 10. It instead covers those areas previously depicted as abraded and overlain with reinforcing material, namely the outer wall, the underside and the wall of the aperture 14.

A purpose of the outer layer is to strengthen the submersible article beyond the strength of the inner body alone. The lower density polyurethane foam used for the inner body, although required for buoyancy, is typically not strong and can be easily damaged. Therefore, a higher density polyurethane foam is used for the outer layer 52 than for the inner body 10. Typically, the foam used for the outer protective skin layer 52 will have a density of between 300 kg/m$^3$ and 1200 kg/m$^3$, or between 700 kg/m$^3$ and 1200 kg/m$^3$, with a higher density giving a tougher layer. Other suitable foam density ranges include 300 kg/m$^3$ to 700 kg/m$^3$, 400 kg/m$^3$ to 1200 kg/m$^3$, 400 kg/m$^3$ to 1000 kg/m$^3$, 400 kg/m$^3$ to 900 kg/m$^3$, 500 kg/m$^3$ to 1200 kg/m$^3$, 500 kg/m$^3$ to 1100 kg/m$^3$, 500 kg/m$^3$ to 1000 kg/m$^3$, 600 kg/m$^3$ to 1200 kg/m$^3$, 600 kg/m$^3$ to 1100 kg/m$^3$, 600 kg/m$^3$ to 1000 kg/m$^3$, 700 kg/m$^3$ to 1100 kg/m$^3$, and 700 kg/m$^3$ to 1000 kg/m$^3$.

The outer layer may advantageously be made from a foam which is semi-flexible. This will give a surface which is greater able to withstand impacts without being damaged.

The outer layer 52 is shown in FIG. 6 as having an approximately constant thickness. However, the outer layer 52 can alternatively be formed with an irregular thickness, to give a protective outer skin with a greater or lesser strength as required by different parts of the submersible article. For example, it may be desirable to provide a thicker and hence stronger outer layer at places where the article is likely to be prone to bumping or collisions in use.

Similarly, it may be desirable to provide the outer layer 52 with a stiffness which varies over the surface of the submersible article, if some parts of the outer surface of the article would benefit from having a greater or lesser stiffness than other parts.

Figure 7:
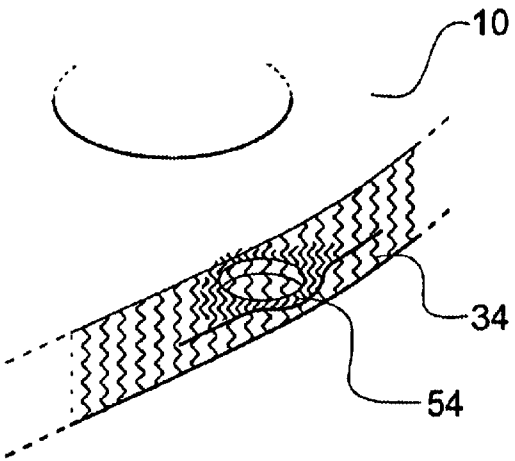
FIG. 7 shows a perspective view of part of a submersible article with reinforcing material applied to its outer surface in accordance with a further embodiment of invention.

FIG. 7 shows a perspective view of part of an inner body 10, and illustrates how a variation in stiffness of this kind can be achieved by applying varying amounts of reinforcing material 34 to areas where a greater stiffness is required. In this case, the inner body 10 features a handle 54 molded integrally with the inner body 10. The stiffness of the outer layer is desired to be higher at the handle 54, so a greater amount of reinforcing material 34 is applied around the area of the handle 54 than elsewhere. Fastening the reinforcing material 34 to the inner body 10 to prevent it from migrating through the outer layer during molding causes the reinforcing material to remain concentrated around the handle 54, to give the desired higher level of stiffness.

Figure 8:
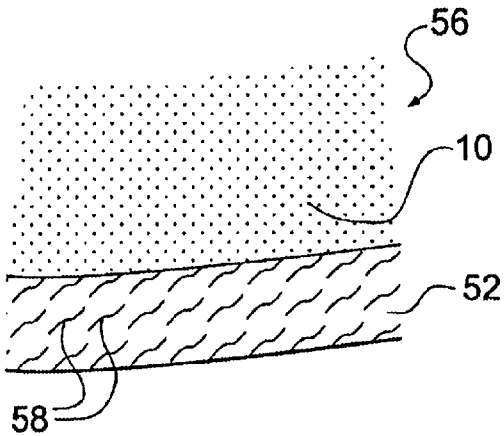
FIG. 8 shows a cross-sectional view of part of the submersible article of FIG. 6.

FIG. 8 shows a schematic cross-section through part of an article 56 having an inner body 10 covered by an outer layer 52 with a constant stiffness. Fibers of glass 58 from the glass fiber reinforcing material applied to the outer surface of the inner body 10 before the molding of the outer layer are distributed reasonably evenly through the outer layer 52.

Figure 9:
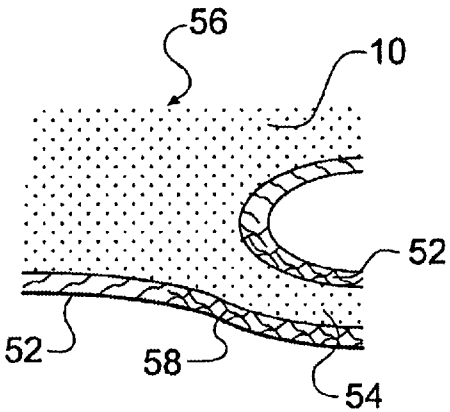
FIG. 9 shows a cross-sectional view of the part of the submersible article of FIG. 7.

FIG. 9 shows a schematic cross-section through part of an article 56 having an inner body 10 with an integrally molded handle 54, and covered by an outer layer 52 with a varying stiffness. The glass fibers 58 in the outer layer 52 are more concentrated around the handle 54 than elsewhere, so that the outer layer 52 is stiffer around the handle 54 than elsewhere. This is achieved by applying more reinforcing material to the handle, as described above with respect to FIG. 7.

EXAMPLE

Figure 10:
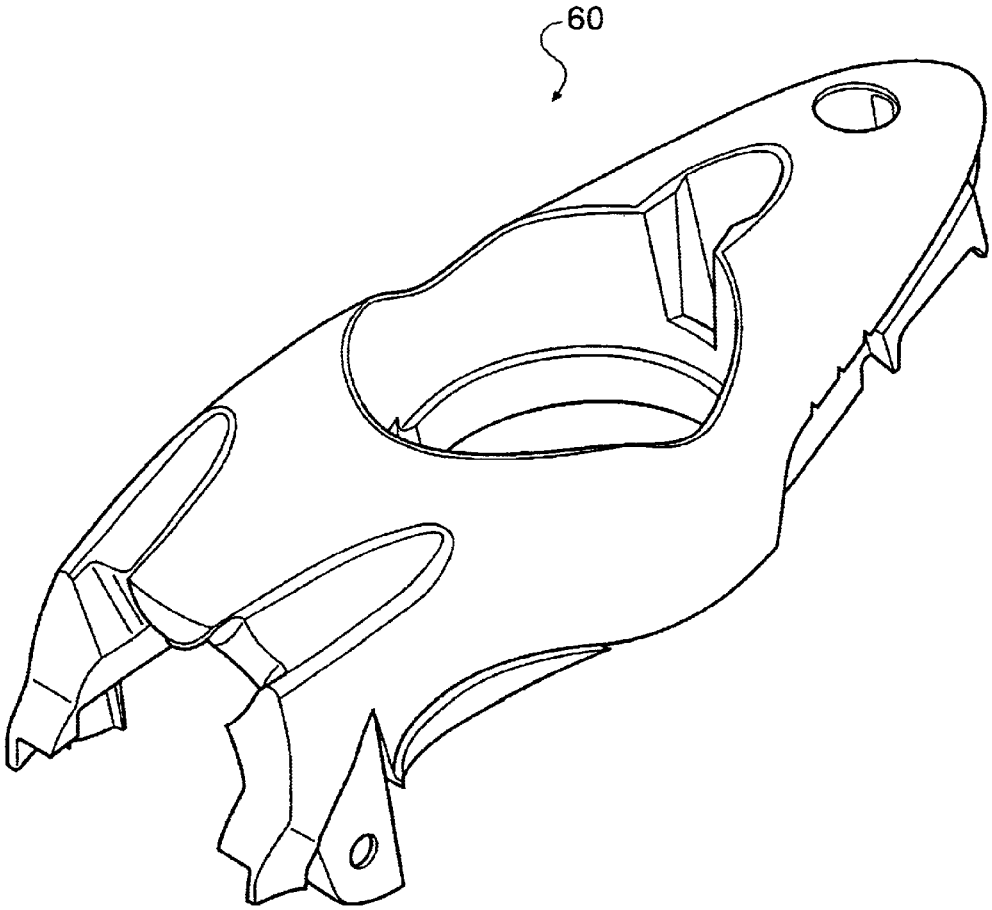
FIG. 10 shows a perspective top view of an inner block forming part of a submersible vehicle according to an example of an embodiment of the invention.

FIG. 10 shows a perspective view of the upper side of an inner block 60 according to a specific example.

Figure 11:
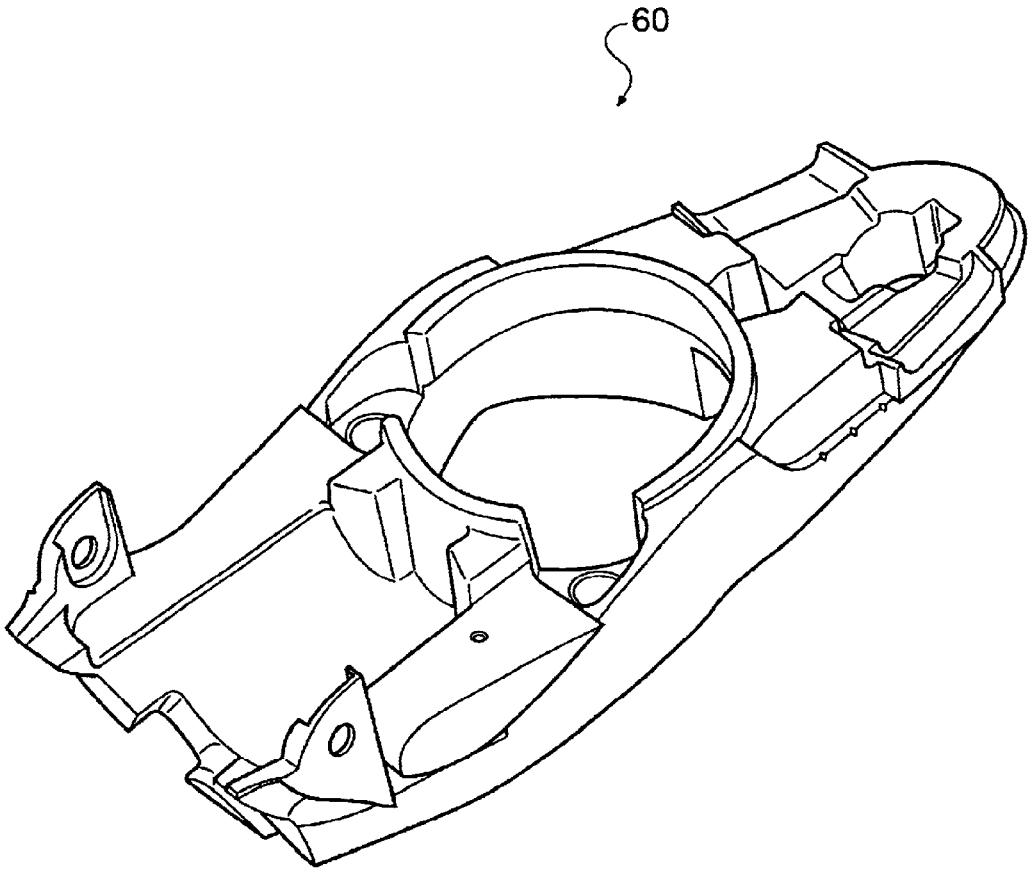
FIG. 11 shows a perspective bottom view of the inner block of FIG. 10.

FIG. 11 shows a perspective view of the underside of the inner block 60. The inner block 60 forms part of a remote-controlled submersible vehicle provided with a camera for making underwater observations.

The inner block is made by molding polyurethane foam in an aluminum mold, as described above. Specifically, the polyurethane foam is formed from a liquid polyurethane mixture. This mixture comprises a polyol made up of 90% Baxenden Chemicals product number 520W and 10% Baxenden Chemicals product number I1226, which are pre-blended together before being mixed with methylene diphenyl diisocyanate (MDI). The mixing is carried out in a high shear rotary mixer for 12 seconds at a temperature of 20–25° C.

The mold, also known as a tool, is made from 6082 grade aluminum. Before molding, the inside of the mold is coated with mold release wax (Acmos product number 35-305-3H) at ambient temperature, and then the parts of the mold are brought together and closed.

The prepared liquid polyurethane is fed into the closed tool, which is then rolled from side to side to fully wet the interior surface of the tool with the liquid. After a cream time of 18–25 seconds, the liquid then reacts to form the polyurethane foam, which expands to fill the tool. The expanding foam is allowed to vent from an exit of the tool for one second, to allow some of the larger air bubbles to escape, before the exit is plugged or bunged. The foam continues to expand inside the plugged tool, so that pressure inside the tool builds up which causes the foam to consolidate. The foam is left to cure for 20–25 minutes, after which the tool is opened and the molded inner body 60 removed. The final density of the molded polyurethane foam is 300 kg/m$^3$, the foam being rigid.

The outer surface of the inner block is then abraded. Also, layers of continuous filament glass fiber ("candyfloss") are laid over the outer surface to give stiffness to the outer layer where required, and held in place with staples.

After this treatment, the inner block is placed into a second tool, pre-treated with mold release wax. A number of mechanical locators or fasteners are used to pull the inner block into the desired position within the second tool.

The second tool is then used to overmold the outer layer over the inner block. This molding step is carried out in the same way as the molding of the inner block, with the foam being allowed to self-vent from the tool; in this instance the following parameters apply:

composition of liquid polyurethane=50% 520W (Baxenden Chemicals) and 50% I1226 (Baxenden Chemicals).

liquid mixing time=12 seconds liquid temperature=20–25° C.

grade of tool aluminum=6082 type of release wax=Acmos product number 35-305-3H release wax temperature=ambient cream time=20–25 seconds cure time=20 minutes This gives an outer layer with a density of 700 kg/m$^3$, the foam being semi-flexible to give the necessary toughness and impact resistance.

Figure 12:
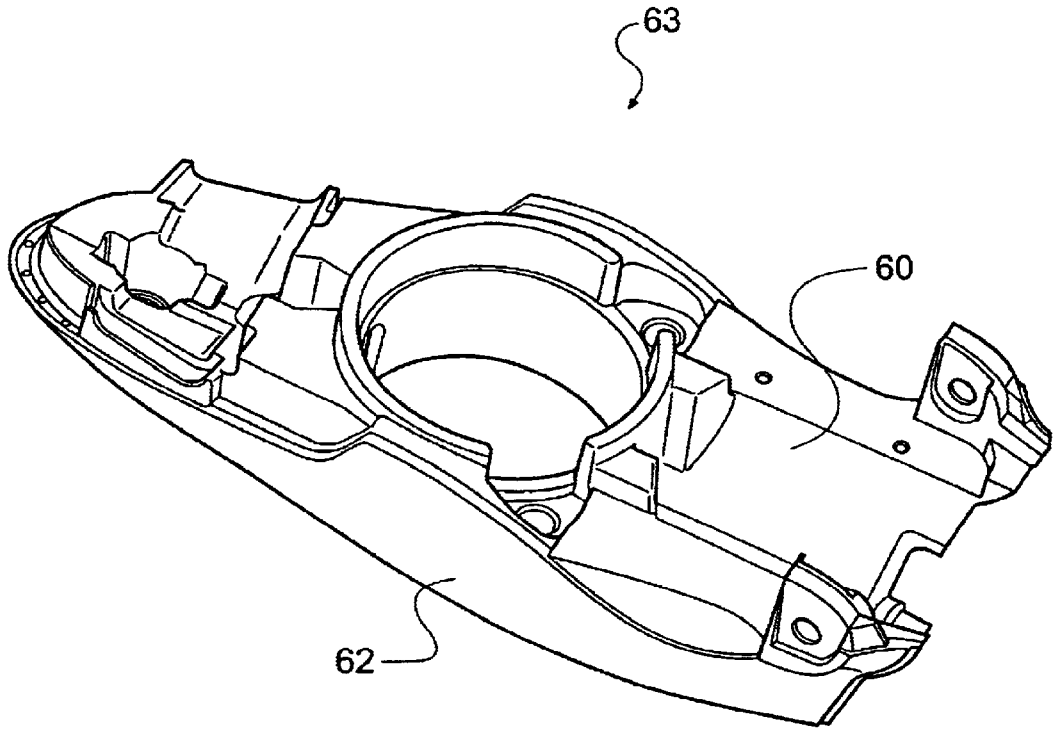
FIG. 12 shows a perspective view of the inner block of FIG. 10 with an outer layer applied to it.

FIG. 12 shows a perspective view of the underside of the finished article 63, comprising the inner block 60 with the overmolded outer layer 62 (shaded parts). Further manufacturing steps which do not form part of the present invention are then carried out on the article to produce the submersible vehicle.

Figure 13:
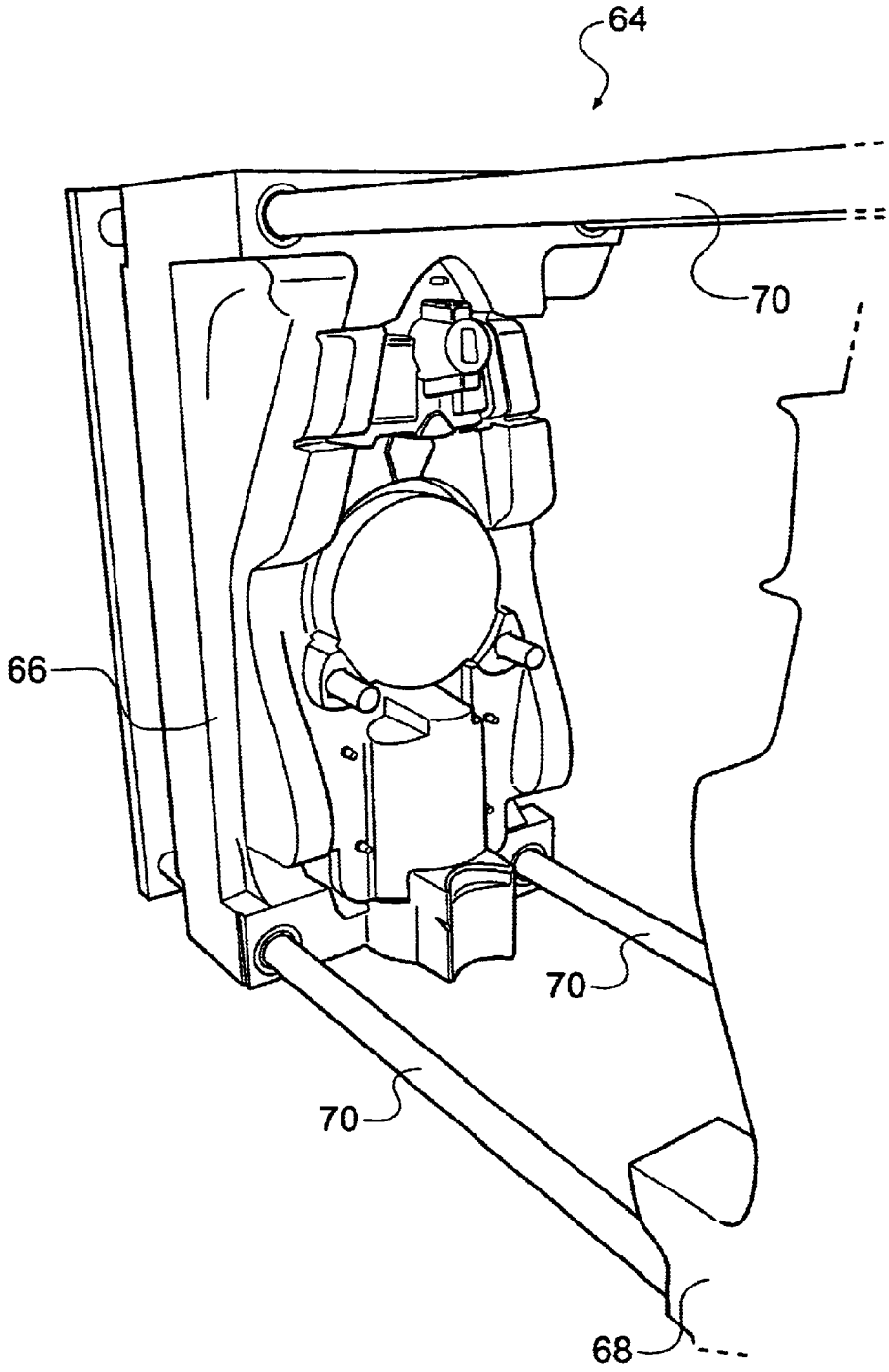
FIG. 13 shows a perspective view of a mold for forming the inner block of FIG. 10.

FIG. 13 shows a perspective view of the tool 64 used to mold the inner body 60. The tool comprises a first tool part 66 and a second tool part 68. The tool parts 66, 68 are mounted on four horizontal rails 70. The tool parts 66, 68 are movable along the rails 70 so that the tool 64 can be opened and closed.

The embodiments and examples of the present invention described above may be modified in a number of ways. For example, the step of abrading the outer surface of the inner body may be omitted if it is found that satisfactory bonding of the outer layer can be achieved without abrasion. Alternatively, the first mold used to form the inner body can be designed to give a textured or rough finish to the inner body, thus removing the need for abrasion to assist in providing a good key for the outer layer. Abrasion may still be carried out to remove mold release agent from the outer layer of the inner body.

Similarly, the step of applying reinforcing material may be omitted if there is no requirement for additional stiffening of the outer layer. This may be the case if, for example, it is appropriate to use a suitable stiff polyurethane directly, or if the submersible article is designed for applications in which stiffness of the outer layer is not beneficial.

Embodiments of the method according to the invention can be used to manufacture a number of separate components, each having a separate inner body and outer layer, which are later assembled to form a submersible article. The assembly may include the addition of various other parts such as power sources, propellers, and control panels, depending on the type of submersible article being made. Alternatively, components of this kind may be integrated into the article during the molding process, by clamping them within the mold and surrounding or partly surrounding them with polyurethane foam.

The outer layer may be applied in more than one molding step. For example, the outer layer may not be continuous over the outer surface of the inner body, but instead take the form of a number of individual parts or "islands" positioned remote from one another over the outer surface. In this case, it may be simpler to perform a separate molding step for each part of the outer layer than to use a complicated mold requiring liquid polyurethane to be poured into a separate opening for each part.

Articles made in accordance with the present invention have application beyond the field of submersibles. Any application which requires parts which are light yet tough and buoyant, and which can be made by molding could potentially benefit from these articles. Examples of items which can include such articles are dive propulsion units, riser flotation jackets for use in the oil industry, body boards, wake boards and kite surfing boards, mooring buoys, fishing net floats, long line floats, jet skis, floating chairs, pedal boats, and other marine/water-sports consumer goods.

What is claimed is:

1. A submersible article comprising:

a buoyancy body formed from polyurethane foam of a first density;

a protective skin formed from polyurethane foam of a second density higher than the first density, wherein the protective skin is overmolded onto the buoyancy body, and at least one of the buoyancy body and protective skin includes an aperture for housing a control and/or power component of the submersible article; and at least one control or power component housed in the aperture.

2. A submersible article according to claim 1, in which the first density is less than at least one of 200, 300, 400, 500 and 600 $kgm^3$.

3. A submersible article according to claim 2, in which the first density is greater than at least one of 100, 200, 300, 400 and 500 $kg/m^3$.

4. A submersible article according to claim 1, in which the second density is less than at least one of 400, 500, 600, 700, 800, 900, 1000, 1100 and 1200 $kg/m^3$.

5. A submersible article according to claim 4, in which the second density is greater than at least one of 300, 400, 500, 600, 700, 800, 900, 1000 and 1100 $kg/m^3$.

6. A submersible article according to claim 1, in which the polyurethane foam of the protective skin has reinforcing material embedded therein.

7. A submersible article according to claim 6, in which the reinforcing material is distributed unevenly in the polyurethane foam of the protective skin, so as to impart a stiffness which varies over the protective skin in a preselected manner.

8. A submersible article according to claim 6, in which the reinforcing material comprises glass fiber.

9. A method of manufacturing a submersible article, comprising:

providing a buoyancy body comprising polyurethane foam of a first density;

placing the buoyancy body in a mold;

overmolding a protective skin onto the buoyancy body using polyurethane foam of a second density higher than the first density;

providing at least one of the buoyancy body and protective skin with an aperture for housing a control and/or power component of the submersible article; and housing at least one control or power component in the aperture.

10. A method according to claim 9, in which the first density is less than at least one of 300, 400, 500 and 600 $kg/m^3$.

11. A method according to claim 10, in which the first density is greater than at least one of 200, 300, 400 and 500 $kg/m^3$.

12. A method according to claim 9, in which the second density is less than at least one of 600, 700, 800, 900, 1000, 1100 and 1200 $kg/m^3$.

13. A method according to claim 12, in which the second density is greater than at least one of 500, 600, 700, 800, 900, 1000 and 1100 $kg/m^3$.

14. A method according to claim 9, further comprising:

arranging reinforcing material over at least part of the buoyancy body before the overmolding so that the reinforcing material embeds in the polyurethane foam of the protective skin during the overmolding.

15. A method according to claim 14, in which the reinforcing material is fastened to the buoyancy body to inhibit movement of the reinforcing material during the overmolding.

16. A method according to claim 14, in which the reinforcing material is distributed unevenly over the buoyancy body, so as to impart a stiffness which varies over the protective skin in a preselected manner.

17. A method according to claim 14, in which the reinforcing material comprises glass fiber.

18. A method according to claim 9, further comprising:

abrading at least part of the buoyancy body prior to the overmolding.

19. A method according to claim 9, in which the mold is provided with at least one locating formation that cooperates with the buoyancy body so as to position the buoyancy body in a preselected arrangement with respect to the mold.

20. A submersible vehicle having a hull comprising:

a buoyancy body formed from polyurethane foam of a first density;

a protective skin formed from polyurethane foam of a second density higher than the first density, wherein the protective skin is overmolded onto the buoyancy body, and at least one of the buoyancy body and protective skin includes an aperture for housing a control and/or power component of the submersible article; and at least one control or power component housed in the aperture.

21. A submersible vehicle according to claim 20, in which the first density is between 100 $kg/m^3$ and 600 $kg/m^3$ and the second density is between 300 $kg/m^3$ and 1200 $kg/m^3$.

22. A submersible vehicle according to claim 20, in which the first density is between 300 $kg/m^3$ and 600 $kg/m^3$ and the second density is between 700 $kg/m^3$ and 1200 $kg/m^3$.

23. A submersible article according to claim 1, wherein the protective skin provides a watertight enclosure for the buoyancy body.

24. A submersible article according to claim 1, wherein the submersible article has a non-circular cross-sectional shape.

25. A submersible article according to claim 1, wherein opposite ends of the submersible article are non-circular.

* * * * *